US005758224A

United States Patent [19]

Binder et al.

[11] Patent Number: 5,758,224

[45] Date of Patent: May 26, 1998

[54] FUSABLE LIFE INDICATOR AND IDENTIFICATION DEVICE FOR AN ELECTROPHOTOGRAPHIC CONSUMABLE PRODUCT

[75] Inventors: Andrew J. Binder; K. Trent Christensen; Quintin T. Phillips, all of Boise, Iowa

[73] Assignee: Hewlett-Packard Company, Palo Alto, Calif.

[21] Appl. No.: 716,754

[22] Filed: Sep. 23, 1996

[51] Int. Cl.[6] ..... G03G 21/00

[52] U.S. Cl. ..... 399/25; 399/27

[58] Field of Search ..... 399/24, 25, 27

[56] References Cited

U.S. PATENT DOCUMENTS 5,202,677 4/1993 Parker et al. ..... 340/786

*Primary Examiner*—Nestor R. Ramirez

*Attorney, Agent, or Firm*—Lane R. Simmons

[57] ABSTRACT

A consumable product such as a toner cartridge for a laser printer includes a messaging device connected thereto. The messaging device is adapted to receive a control signal from the printer or other host, the control signal being indicative of a use status for the consumable product, such as "toner low". The control signal produces a visual effect upon the messaging device such that a message or a change in message concerning the consumable product is indicated thereby. The message or change in message is, alternatively, indicative of an identifier for the consumable product. The messaging device is a resistive heater substrate having at least one layer of thermochromatic ink disposed thereon. In an alternate embodiment, the message or change in message is effected by a change in temperature upon the messaging device, rather than by a direct control signal. In another alternate embodiment, a fuse is connected to the messaging device for providing further information to the printer system.

19 Claims, 4 Drawing Sheets

FUSABLE LIFE INDICATOR AND IDENTIFICATION DEVICE FOR AN ELECTROPHOTOGRAPHIC CONSUMABLE PRODUCT

FIELD OF THE INVENTION

This invention relates in general to imaging apparatus and, in particular, to monitoring a use status of a consumable product, such as a toner cartridge for a laser printer, and to identifying the product.

BACKGROUND OF THE INVENTION

Many image forming apparatus, such as laser printers, copy machines, and facsimile machines, utilize well known electro-photographic printing processes. These image forming apparatus use toner, or the "ink" of the imaging process, to print or copy the desired image or words onto a piece of paper or media. The toner is contained in a hopper (reservoir), and is eventually depleted after a certain number of printing processes. For example, the toner in a conventional laser printer might be depleted after printing approximately 1000 pages. However, the depletion number depends on several factors, such as the type and density of images being printed, volume of the toner hopper, etc.

A disposable toner cartridge is often used in certain imaging systems, such as laser printers, and is conventionally identified as a "consumable" or "consumable product" because of its limited "life" (i.e., the toner will eventually deplete or some other component will eventually wear out). The cartridge typically includes a toner hopper, seal assembly, mounting member, magnetic roller assembly, photoconductive drum assembly and charging corona or roller assembly. These items and other similar components are also commonly identified as consumables because they too have a limited life.

Unfortunately, the conventional toner cartridge design does not provide a good means for indicating the status of the cartridge relative to its useful life and, especially, relative to the toner level in the cartridge. Although certain imaging systems (for example, certain laser printers) are designed to detect when the toner level nears depletion and are capable of displaying a status message such as "toner low" on a display panel, these do not provide a means for visually determining whether the cartridge is spent when it is physically extracted from the printer engine. This is a common inconvenience for consumers and manufacturers alike who need to know, for example, the toner level of a given cartridge, without having to go through the steps of inserting the cartridge into the printer. In fact, whether a cartridge is spent or exhausted is often determined only by weighing the cartridge, which may be inaccurate due to the various design and manufacturing versions of the consumable (i.e., the weight is dependent on the parts make-up of the consumable).

Typically, toner low sensors (or antennae) in toner cartridges detect only when the toner approaches the level in the hopper where the sensor is placed (near the development sleeve). As the toner level approaches the level of the sensor, the dielectric state between the sensor and sleeve changes and is detected by the printer system to signal the toner low message. Multiple sensors are not feasible for detecting varying toner levels (or a gradation of toner level) because of the electrical requirement that the sensors remain near the development sleeve of the printer. Namely, the greater the distance of the sensor from the sleeve, the greater the loss of signal strength due to the high dielectric properties of the toner.

An alternate method in the art for detecting toner level is to count or monitor the number of pixels (dots) of toner used relative to a previously known amount of toner. However, this method may be inaccurate due to variations in print image, and environmental conditions and age of the cartridge. Furthermore, it is often more costly than desirable for certain lower-end imaging systems, and does not provide a means for visually detecting the toner level (or "use-status") of the cartridge when the cartridge is removed from the imaging system.

Another problem associated with disposable toner cartridges and other consumables is that they will often be refurbished (i.e., the toner will be refilled) for reuse by an entity other than the original manufacturer. As such, there is a potential for consumer confusion with regard to whether the cartridge is refurbished by the original manufacturer or not. This is especially critical to consumers and/or manufacturers who want to be sure that a cartridge has been refurbished by an appropriately authorized entity.

Accordingly, objects of the present invention are to provide an improved system and method for (i) indicating a life status (or use status) of a consumable, such as toner level in a toner cartridge, and for (ii) identifying the consumable relative to other products and or imitations.

SUMMARY OF THE INVENTION

According to principles of the present invention in a preferred embodiment, a consumable product such as a toner cartridge for a laser printer includes a messaging device connected thereto. The messaging device is adapted to receive a control signal from the printer, the control signal being indicative of a use (or life) status, such as "toner low", for the consumable product. The control signal produces a visual effect upon the messaging device such that a message or a change in message concerning the consumable product is indicated thereby.

According to further principles of the present invention in an alternate embodiment, the message or change in message is indicative of an identifier for the consumable product. For example, the message may change from displaying a manufacturer's trademark, indicative of the consumable being an authorized product, to not displaying the trademark upon exhaustion of the product.

In a preferred embodiment, the messaging device is a conductive substrate, such as a resistive heater, having at least one layer of thermochromatic ink disposed thereon. In an alternate embodiment, a fuse is used in connection with the conductive substrate. The state of the fuse signals a use status of the consumable directly to the printer. The control signal from the printer causes the messaging device to display a message or change in message and also causes the fuse to blow. In another alternate embodiment, the message or change in message is effected by a change in temperature around the messaging device, rather than by a direct control signal.

The present invention messaging device in connection with a consumable product provides a simple and effective means for visually (i) indicating a use/life status of the consumable, even after the consumable is removed from its host (i.e., the printer), and for (ii) identifying the consumable relative to other products and or imitations.

Other objects, advantages, and capabilities of the present invention will become more apparent as the description proceeds.

DETAILED DESCRIPTION OF THE INVENTION

Figure 1:
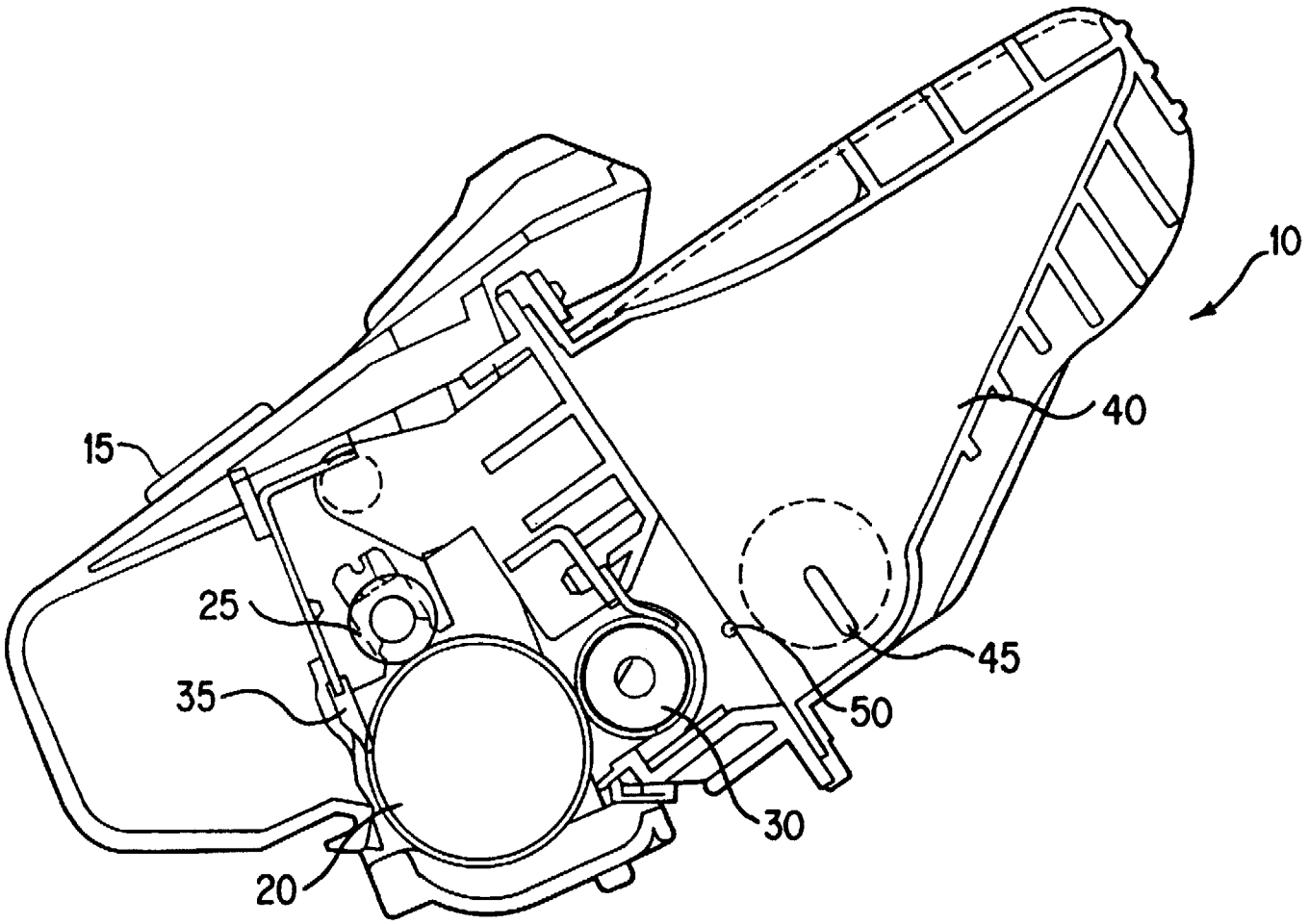
FIG. 1 is a cross sectional elevation view of a laser printer toner cartridge (consumable) having a messaging device connected thereto for providing information regarding the consumable under principles of the present invention.
Figure 2:
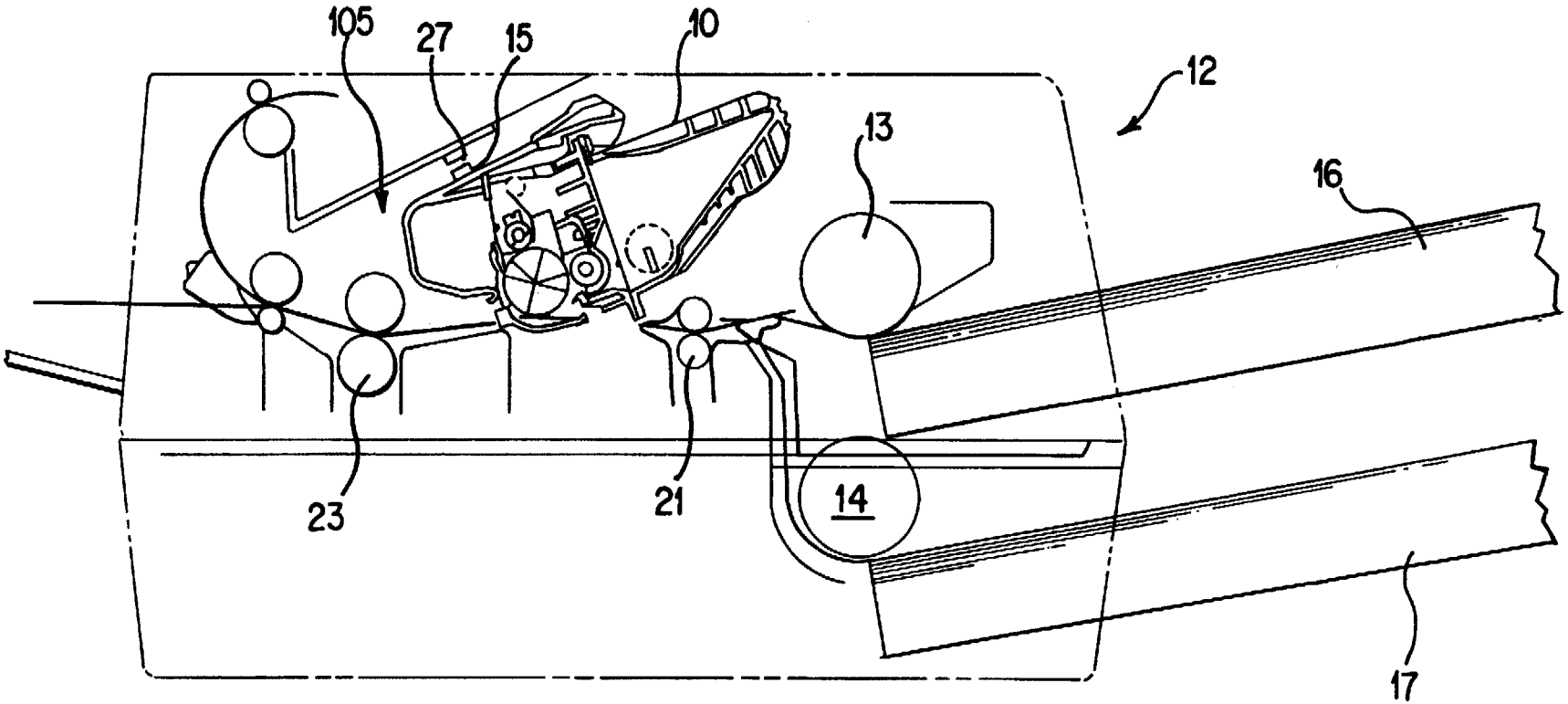
FIG. 2 is a cross sectional elevation view showing the toner cartridge inserted within a host electrophotographic printer.

FIG. 1 is a cross sectional elevation view of a laser printer toner cartridge (consumable) 10 having messaging device 15 connected thereto. Messaging device 15 provides visual use status (or life status) indicia and/or product identification information regarding the consumable in response to a signal supplied thereto. For ease of discussion purposes, the present invention messaging system is disclosed in reference to toner cartridge 10 for a host laser printer 12 (FIG. 2). However, it is obvious that the principles are also applicable to other consumable products, imaging systems, and/or electrical systems.

Cartridge 10 includes photoconductive drum roller 20, charge roller 25, developer 30, cleaning blade 35, toner reservoir (hopper) 40 with toner agitator 45, and "toner low" sensor (antennae) 50. Messaging device (or label) 15 is securely attached to cartridge 10 in a manner such that the functional operation of the cartridge is not disturbed in connection with its intended use in a host laser printer. However, it is attached so as to receive a control signal from the host printer, the signal being indicative of a use or life status (jointly referred to herein as "use" status) of cartridge 10. The signal may be transmitted to messaging device 15 via a form of light wave transmission, such as infrared or light emitting diode, or via an electrically conductive or inductive connection. In a preferred embodiment, messaging device 15 connects to its host via electrical contact points. Alternatively, cartridge 10 self generates the control signal transmitted to messaging device 15.

Messaging device 15 is attached to cartridge 10 so as to be clearly visible by a user or manufacturer for interpreting any message displayed on the messaging device. It is preferable to be able to visually observe messaging device 15 when cartridge 10 is mated or inserted within its host, as well as when it is extracted from the host. However, for simplicity of electrical connection, it is preferable to place the messaging device 15 as shown for ease of interfacing with the host. Messaging device 15 is attached to cartridge 10 using any conventional means in the art, such as adhesive, screw, rivet, etc.

FIG. 2 is a cross sectional elevation view showing cartridge 10 inserted within host electrophotographic (EP) printer 12. As conventional in the art, printer 12 includes feed rollers 13 and 14 for feeding the printing sheets stacked in the printing sheet cassettes 16 and 17, a pair of rollers 21 for conveying a printing sheet fed from the printing sheet cassettes 16 or 17, and a pair of heat rollers 23 for fixing the toner transferred on the printing sheet. Specific to the present invention, printer 12 includes contact element 27 for connecting with messaging device 15 of cartridge 10 for transmitting of a control signal.

Figure 3:
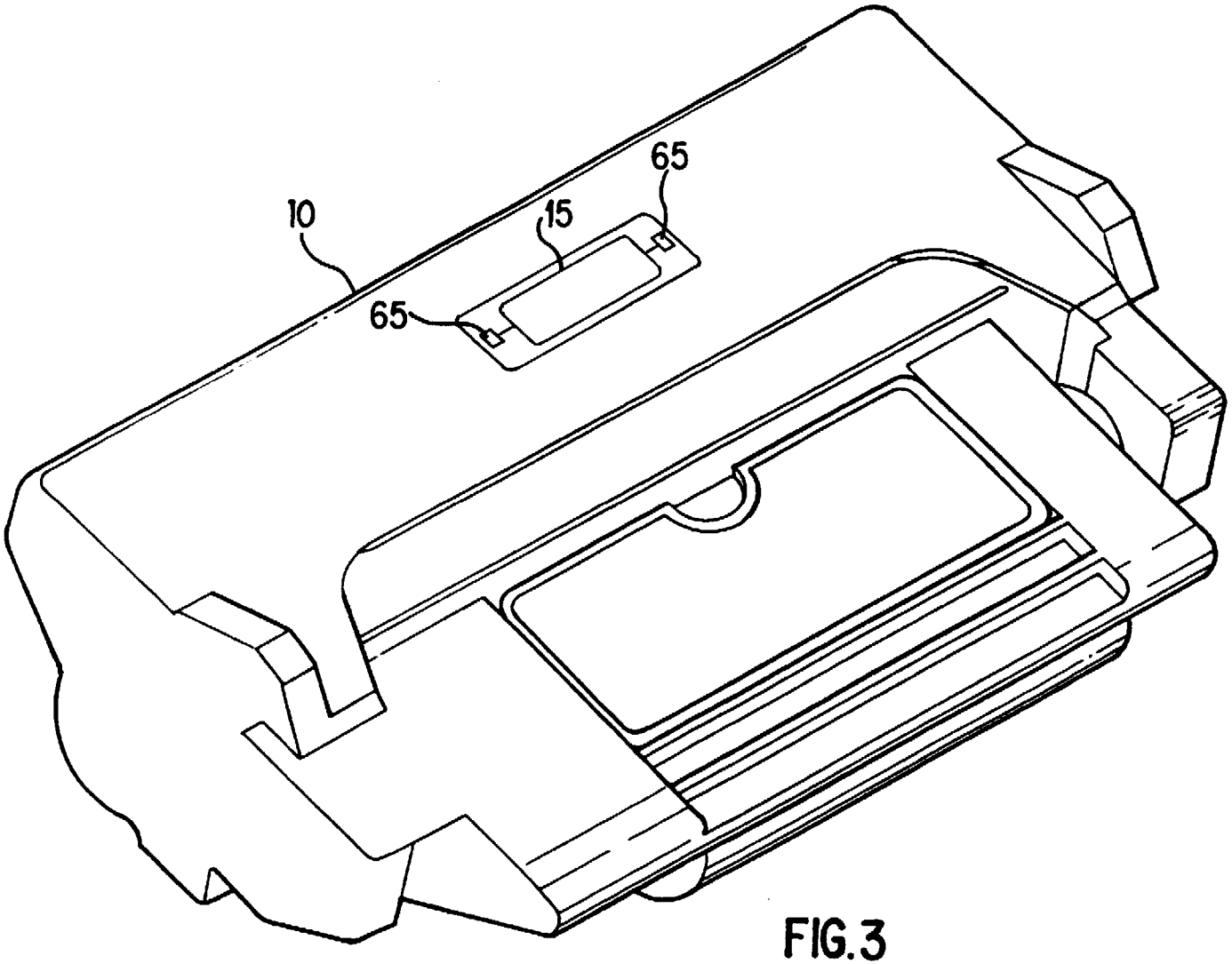
FIG. 3 is a perspective view of the toner cartridge showing one embodiment of a messaging device attached to the cartridge.

FIG. 3 is a perspective view of toner cartridge 10 showing messaging device 15 attached to the cartridge in one embodiment. Messaging device 15 is positioned on the cartridge so that electrical contacts 65 interface with contacts 27 on host 12. However, messaging device 15 could be attached to cartridge 10 at various locations of the cartridge, so long as the host's contacts 27 are repositioned to appropriately mate with contacts 65.

Figure 4:
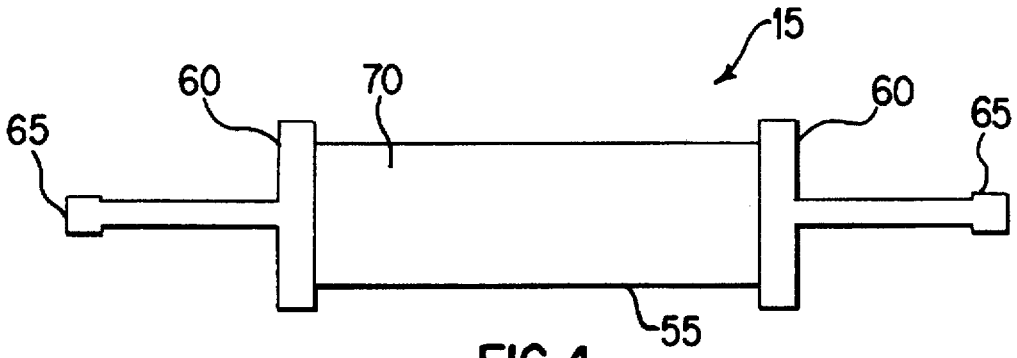
FIG. 4 is a top plan view of one embodiment of the messaging device.

FIG. 4 is a top view of messaging device 15 having body 55, electrodes 60, and electrical contacts 65. Body 55 is a resistive heater substrate which heats in response to an electrical voltage signal applied at electrodes 60 through contacts 65. Resistive heater 55 may be formed from any number of conventional materials in the art, such as silver conductive ink, aluminum, etc., and is formed to design criteria specific to the application at hand as described further herein. Namely, the conductive material, thickness, resistance, etc., of body 55 are dependent upon electrical properties desired for purposes described herein and as known to those of ordinary skill in the art.

A thermochromatic ink 70 is screen printed over body 55 and changes color in response to heat generated from resistive heater 55. Thermochromatic ink 70 may be a reversible or non reversible ink as well known in the art. The combination of resistive heater 55 and thermochromatic ink 70 provide an effective messaging means for consumable 10. For example, a message is first imprinted or screened on resistive heater 55, and then a dark (opaque) color thermochromatic ink is subsequently screened over the message on the resistive heater to hide the message. Upon applying a signal to contacts 65, resistive heater 55 heats and causes thermochromatic ink 70 to change to a clear (transparent) color such that the message becomes visually perceptible.

Figure 5:
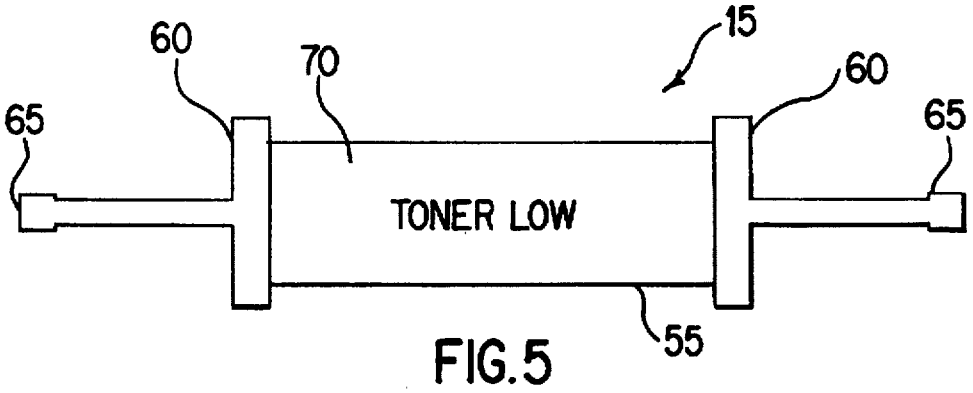
FIG. 5 is a top plan view of the messaging device displaying an exemplary message of "toner low" in response to a signal applied thereto.

FIG. 5 shows an example of how a message of "toner low" appears after heating resistive heater 55 in response to a signal applied at contacts 65. Obviously, this "toner low" message is especially useful to a consumer or manufacturer who needs to know the toner level in toner cartridge 10 (FIG. 1). The message is hidden by thermochromatic ink 70 when the toner supply is not low, but becomes visible when the printer senses the toner level is low (by any conventional means, such as toner sensor/antennae 50 of FIG. 1). The printer then generates a signal that is applied to contacts 65, sufficient to heat body 55 and to cause ink 70 to change to its transparent color for displaying the message. Alternatively, cartridge 10 is configured to generate its own signal to be transmitted to messaging device 15 upon sensing the low toner level.

Messaging device 15 may be formed according to various configurations and electrical properties that are dependent only upon design criteria for the messaging system as a whole, including physical and electrical properties of consumable 10 and host 12. For example, in one test instance, a reversible chromatic ink label (messaging device) changed from black to clear with four (4) volts and 1.25 amps applied at contacts 65 in one minute of elapsed time. Resistive heater 55 achieved 180° F. and the ink was completely changed from opaque to transparent. Since a reversible ink was used, the ink changed back to black when subjected to 50° F. for a short period of time. The resistive heater was formed from silver conductive ink at about 0.0005 inch thickness. This example demonstrates how an electrical control signal produces a visual effect upon the messaging device such that a message may be displayed for whatever purpose. However, for the context of displaying a single message regarding a consumable product (cartridge) 10 of FIG. 1, the reversible ink is not preferred because the message may be inadvertently reversed and hidden again. Rather, if a non reversible ink were used, a message such as "toner low" could be placed on body 55 under the ink, and when the ink changed color, the "toner low" message would appear and remain permanently visible for a user or manufacturer to see.

In another test instance, a non-reversible chromatic ink label changed from clear to black with four (4) volts at 1.25 amps in one minute elapsed time. Resistive heater 55 achieved 200° F. and the ink completely changed from transparent to opaque. The resistive heater was formed from silver conductive ink at about 0.0005 inch thickness. This example demonstrates an alternate usage for effectuating a message through messaging device 15. This form of messaging, for example, allows a manufacturer to place its trade name (or the product name, or the like) on body 55, and have the name remain visible to the consumer, due to the transparent ink, prior to a control signal being applied through contacts 65. However, once a signal is applied, the ink darkens to hide the name. In this manner, and in the exemplary context of a toner cartridge, the product is recognized as an authorized product with the trade name (or product name) visible when the cartridge is new. Once the cartridge is spent, the name disappears. The name will then be reinstated only by an authorized entity when the cartridge is refilled or remanufactured. If the name is not visible when the cartridge is new (refilled or remanufactured), then the consumer may know that it is not an authorized product. This example also demonstrates how ink 70 and resistive heater 55 may, optionally, be designed to respond to different electrical properties such that varying temperatures are generated by the heater to render different color change activation levels in the ink.

Figure 6:
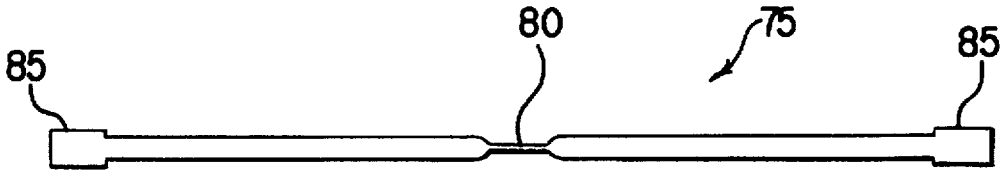
FIG. 6 is a top plan view of a fuse that when combined with the messaging device provides an alternate embodiment messaging system.

Referring now to FIG. 6, a top plan view of fuse 75 is depicted that, in an alternate embodiment of the present invention, is combined with messaging device 15 by overlaying messaging device 15 over fuse 75 to form an "integrated" messaging device. Fuse 75 has a thin middle cross section 80 that is burned out or "blown" when too much current is applied therethrough via electrical contacts 85. Fuse 75 may be of a conventional fuse material, such as silver ink. An exemplary fuse was constructed at 0.2 inches in length, 0.002 inches in width, and blew in one second at four volts and 1.15 amps.

Although fuse 75 could be used alone in connection with a consumable to display a "message" to the user (the message being understood by the fact that the fuse has or has not been blown) it is preferable to integrate the fuse with messaging device 15 for attachment to consumable 10 or the like. Similar to messaging device 15, a signal is applied to contacts 85 (by a host to which the consumable is mated) upon some identified event occurring to the consumable. During processing, the host recognizes (detects) when and if the fuse is blown and operates accordingly as delineated by design criteria set for the system. For example, once a "toner low" has been sensed by a printer host through a conventional sensor/antenna associated with the toner cartridge, the host can blow fuse 75 on the cartridge, either alone or in addition to displaying a message through messaging device 15. Subsequently, any time that same cartridge is inserted (with the blown fuse), the printer can quickly and easily detect that the fuse is blown and that the cartridge is low on toner.

Another implementation for the messaging device and messaging system of the present invention includes attaching a plurality of the messaging devices (and/or fuses) to a consumable such that multiple messages are displayable or a "gradation gauge" is created thereby. Furthermore, in yet another alternate embodiment, instead of using multiple devices, a single messaging device is formed to include a plurality of messages thereon such that each message is capable of being legibly discerned upon the occurrence of a distinguishing event. In conjunction with the single messaging device, a plurality of fuses 75 may be connected, with each being designated to blow in response to a distinguishing event (i.e., in response to a specific voltage or amperage).

Figure 7:
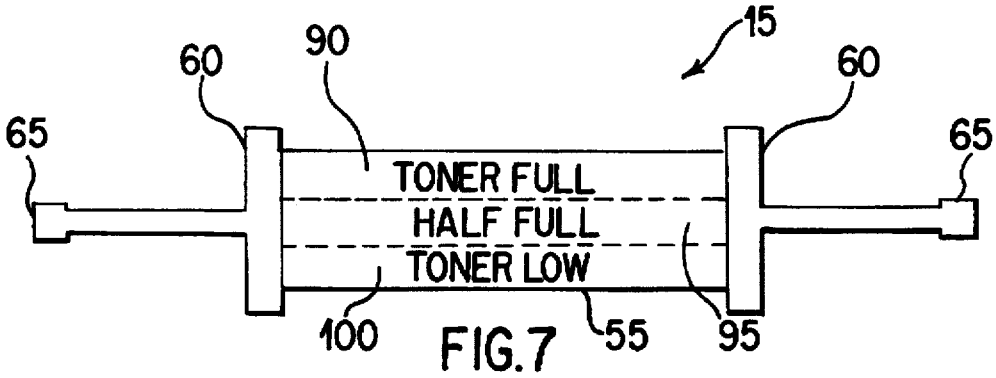
FIG. 7 is a top plan view of the messaging device depicting how multiple messages may be embodied in one messaging device, visualized in response to a variety of control signals received.

For example, as shown in FIG. 7, one messaging device 15 includes various messages thereon: "Toner Full", "Half Full" and "Toner Low". Each message is screened over by a thermochromatic ink 90, 95 and 100 that is chosen to change color at a specifically chosen applied signal, i.e., a different amperage or voltage. When the cartridge is new, ink 90 is clear so that the "Toner Full" message remains visible, and ink 95 and 100 are opaque so those messages are hidden. When the cartridge is sensed by the printer to be "Half Full", the correct amperage is applied to contacts 65 to cause ink 95 over the "Half Full" message to change to clear such that the message can be read. Simultaneously, ink 90 over the "Toner Full" message changes to dark such that the "Toner Full" message can no longer be read. In addition, a first fuse 75 may be blown, indicative of a "half full" status, so that the printer system knows immediately what the status is upon extraction and reinsertion of the cartridge.

Similarly, when the toner level is detected as being low, a different level of amperage is applied to cause screened ink 100 over the "Toner Low" message to become clear such that the message can be read. Simultaneously, the ink over the "Half Full" message changes to dark such that it can no longer be read. In addition, a second fuse may be blown, indicative of a "toner low" status so that the printer system knows immediately what the status of the cartridge is upon extraction and reinsertion into the printer system.

Finally, referring back to FIGS. 4, 5 and 6, in yet another alternate embodiment, messaging device 15 and/or fuse 75 have no need of receiving any electrical signal through contact terminals 65 and/or 85. Rather, cross section 80 is blown or a message on body 55 is thermally visualized in response to environmental conditions around cartridge 10, such as by heat generated from printer system 12 (FIG. 2). Specifically, printer cartridge compartment 105 (FIG. 2) experiences elevated temperatures during printer operation. For example, temperatures in excess of 45° C. have been measured in such a compartment, mostly generated by fuser rollers 23. In this alternate embodiment, thermochromatic ink 70 and/or fuse 75 are designed to respond to the elevated temperature and thereby, respectively, (i) automatically cause the ink to change color such that a message is displayed on the messaging device, and/or (ii) automatically cause the fuse to blow.

This approach is simple to implement since no electrical signal needs to be generated by the printer or received by the messaging device, yet it is effective for indicating a message to a consumer. Furthermore, when using elevated temperature rather than a specific electrical signal to cause the display of the message, contacts 65 and/or 85 may be omitted and, respectively, contacts 27 may be omitted from printer 12.

An example of usage for this type of messaging device is to indicate, simply, that the cartridge has been used. Namely, an unambiguous method of indicating cartridge use is provided by firmly affixing messaging device 15 to the exterior of cartridge 10 and causing the messaging device to develop a "used cartridge" message when exposed to the elevated temperatures of compartment 105. The messaging device (and/or fuse) is permanently attached to the cartridge with a permanent adhesive. After a short period of cartridge use, the heat from the printer will develop the message on the messaging device to indicate the cartridge has been used. This permanently marks the cartridge as a used item, thereby reducing the opportunity for fraud. Attempts to remove the messaging device will produce obvious damage to the cartridge, further indicating tampering, and thereby reducing attempts at fraudulent marketing, refurbishing, refilling, etc. of the cartridge.

In summary, messaging device 15 and optional fuse 75, in connection with a consumable product (such as cartridge 10), serve to provide a message or a change in message on the exterior of the consumable at a desired time (i.e., "toner low", "exhausted", etc.) in response to a control signal applied thereto. The messaging device provides at least two states for communicating messages, including a first state prior to receiving the control signal, and at least a second state after having received the control signal. Thus, a message or a change in message is displayed, depending upon the state or frame of reference. Obviously, the power requirements for producing the reaction in the messaging device and/or fuse are, preferably, within the voltage and amperage available in the host (i.e., printer system in this example). Fuse 75 provides an additional means for detecting the life status of the product. In alternate-embodiments, messaging device 15 and fuse 75 are activated by elevated temperatures rather than direct control signals. Advantages of the present invention messaging system include:

(1) customers are able to look at a consumable (i.e., toner cartridge) and immediately know a toner usage status;

(2) manufacturers are also able to visually detect empty cartridge returns without concern that the cartridge was mistakenly returned unused and without having to check toner status by physically weighing the cartridge;

(3) trade names or product names for specific cartridges are easily identified with the cartridge to verify authenticity of the cartridge from the manufacturer (for example, to determine whether the cartridge has been refurbished or refilled by an authorized manufacturer).

What has been described above are the preferred embodiments for an EP consumable life indicator and product identification system. It will be obvious to one of ordinary skill in the art that the present invention is easily implemented utilizing any of a variety of components and tools existing in the art. Moreover, while the present invention has been described by reference to specific embodiments, it will be apparent that other alternative embodiments and methods of implementation or modification may be employed without departing from the true spirit and scope of the invention.

What is claimed is:

1. A consumable product having a messaging device connected thereto, the messaging device being responsive to indicia indicative of a use status for the consumable product, and wherein the indicia produces a visual effect upon the messaging device such that a message or a change in message concerning the consumable product is indicated thereby;

and wherein the messaging device includes at least one of: (i) an electrically sensitive body, or (ii) an environmentally sensitive body:

and wherein the indicia is selected from one of: (i) a control signal in the event the messaging device is an electrically sensitive body, and wherein the messaging device is adapted to receive the control signal; or, (ii) a change in environmental conditions around the messaging device in the event the messaging device is an environmentally sensitive body, and wherein the messaging device is adapted to respond to the change in environmental conditions;

and wherein the at least one electrically sensitive body or environmentally sensitive body comprises: (i) at least one layer of thermochromatic ink disposed over a substrate, or, (ii) at least one layer of thermochromatic ink disposed over a substrate, and at least one fuse;

and wherein the thermochromatic ink is a non reversible ink such that the visual effect upon the messaging device is permanent.

2. The consumable product of claim 1 wherein (i) the control signal comprises an electrical signal, or (ii) the change in environmental conditions comprises a change in temperature.

3. The consumable product of claim 1 wherein the consumable product is selected from one of a toner cartridge and an ink cartridge for an image forming device, and wherein the message or change in message is indicative of, respectively, an amount of toner usage for the toner cartridge and an amount of ink usage for the ink cartridge.

4. The consumable product of claim 1 wherein the messaging device provides at least two states for communicating messages, including a first state prior to responding to the indicia, and at least a second state after responding to the indicia.

5. The consumable product of claim 1 wherein the message or change in message is indicative of (i) a use status for the consumable product, or (ii) an identifier for the consumable product.

6. The consumable product of claim 1 wherein the visual effect includes a color change in the thermochromatic ink responsive to the control signal or the change in environmental conditions.

7. A consumable product for use in connection with a host, the consumable product having a messaging device connected thereto, the messaging device being adapted to respond to a change in temperature of the host, wherein the change in temperature of the host is actively generated by the host and produces a visual effect upon the messaging device such that a message or a change in message concerning the consumable product is indicated thereby, and wherein the consumable product is selected from one of a toner cartridge and an ink cartridge for an image forming device, and wherein the message or change in message is indicative of, respectively, an amount of toner usage for the toner cartridge and an amount of ink usage for the ink cartridge.

8. The consumable product of claim 7 wherein the message or change in message is indicative of (i) a use status for the consumable product, or (ii) an identifier for the consumable product.

9. The consumable product of claim 7 wherein the messaging device includes at least one thermally sensitive body.

10. The consumable product of claim 9 wherein the at least one thermally sensitive body comprises: (i) at least one layer of thermochromatic ink disposed over a substrate, or, (ii) at least one layer of thermochromatic ink disposed over a substrate, and at least one fuse.

11. The consumable product of claim 10 wherein the thermochromatic ink is a non reversible ink such that the visual effect upon the messaging device is permanent.

12. A messaging system for communicating a message concerning a consumable product, the system comprising:

(a) a messaging apparatus connected to the consumable product;

(b) means for mating the consumable product with a host; and, (c) means for applying a signal to the messaging apparatus, the signal being in response to a detected use status of the consumable product, whereby the messaging apparatus responsively displays a message or a change in message concerning the consumable product;

and wherein:

the consumable product is selected from one of a toner cartridge and an ink cartridge, and the host is an image forming device; and, the message or change in message is indicative of (i) a toner level use status for the toner cartridge, (ii) an ink level use status for the ink cartridge, or, (iii) an identification for the consumable product.

13. The messaging system of claim 12 wherein the messaging apparatus includes at least one electrically sensitive body and electrical contacts connected to the body for electrically connecting with the host and receiving the applied signal, and wherein the electrical contacts are positioned on the consumable product for electrically connecting with the host.

14. The messaging system of claim 13 wherein the electrically sensitive body comprises (i) at least one layer of thermochromatic ink disposed over a substrate, or, (ii) at least one layer of thermochromatic ink disposed over a substrate, and at least one fuse in electrical connection with the electrical contacts of the messaging device.

15. The messaging system of claim 14 wherein the thermochromatic ink is a non reversible ink such that the message or change in message displayed concerning the consumable product is permanently displayed upon receiving the applied signal.

16. The messaging system of claim 14 wherein the message or change in message displayed includes a color change in the thermochromatic ink responsive to the applied signal.

17. The messaging system of claim 16 wherein legible text, a graphic logo, or a combination of text and logo is (i) rendered visually distinguishable upon the change in color, or (ii) rendered visually indistinguishable upon the change in color.

18. The messaging system of claim 12 further including a plurality of messaging apparatus connected to the consumable product, and wherein each messaging apparatus is electrically connected to the host and adapted to receive an applied signal for responsively displaying a message or change in message concerning the consumable product.

19. The messaging system of claim 18 wherein the plurality of messaging apparatus together provide a gradation gauge for visually representing a useful life status of the consumable product.

* * * * *